United States Patent [19]

Eriksson et al.

[11] 3,990,888

[45] Nov. 9, 1976

[54] DECARBURIZATION OF A METAL MELT

[75] Inventors: Lars Anders Eriksson, Hagfors; Karl-Erik Öberg, Borlange, both of Sweden

[73] Assignee: Uddeholms Aktiebolag, Hagfors, Sweden

[22] Filed: Jan. 6, 1975

[21] Appl. No.: 538,709

Related U.S. Application Data

[63] Continuation-in-part of Ser. No. 403,854, Oct. 5, 1973, Pat. No. 3,867,136.

[30] Foreign Application Priority Data

Jan. 22, 1974 Sweden ..... 7400831
Oct. 6, 1972 Sweden ..... 12907/72

[52] U.S. Cl. ..... 75/60; 75/59
[51] Int. Cl.[2] ..... C21C 5/34
[58] Field of Search ..... 75/59, 60

[56] References Cited

UNITED STATES PATENTS

| | | | |
|---|---|---|---|
| 3,330,645 | 7/1967 | De Moustier | 75/60 |
| 3,751,242 | 8/1973 | Knuppel | 75/60 |
| 3,779,534 | 12/1973 | Leroy | 75/60 |
| 3,844,768 | 10/1974 | Leroy | 75/60 |
| 3,867,136 | 2/1975 | Eriksson | 75/60 |
| 3,898,079 | 8/1975 | Eriksson | 75/60 |

FOREIGN PATENTS OR APPLICATIONS

| | | | |
|---|---|---|---|
| 1,450,718 | 7/1966 | France | 76/60 |

*Primary Examiner*—Peter D. Rosenberg
*Attorney, Agent, or Firm*—Cushman, Darby & Cushman

[57] ABSTRACT

In a process for reducing the carbon content of an iron, cobalt or nickel based alloy containing carbon and at least 10% by weight chromium by introducing into the molten alloy, through at least one inner section of a tuyere which comprises at least two concentric tubes, essentially pure steam or steam and any inert gas belonging to the group consisting of nitrogen, argon, helium, neon and xenon, blockage of gas inlet is avoided by passing a gas mixture containing between 5 and 30% by volume of gaseous oxygen through an outermost section of the tuyere.

3 Claims, 1 Drawing Figure

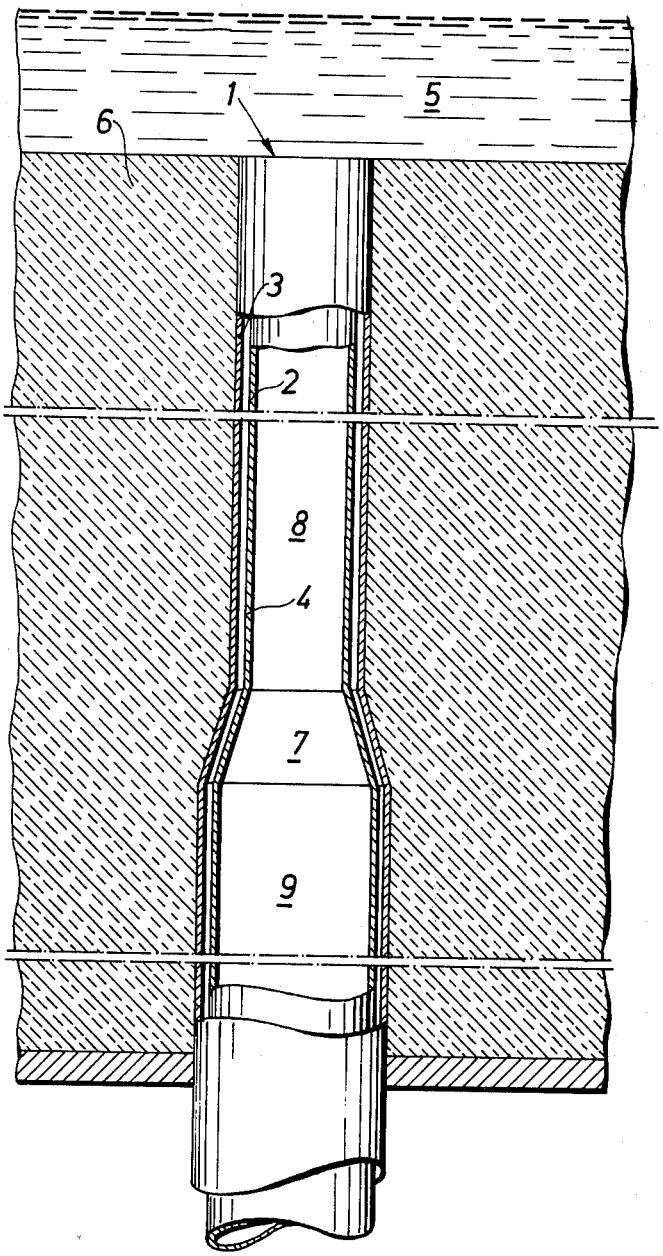
1
5
6
3
2
8
4
7
9

DECARBURIZATION OF A METAL MELT

This application is a continuation-in-part of our copending application Ser. No. 403,854 filed Oct. 5, 1973, now U.S. Pat. No. 3,867,136.

The present invention relates to an improved method of reducing the carbon content of an iron, cobalt or nickel based alloy containing carbon and at least 10% by weight chromium by introducing steam into the molten alloy, said steam decomposing in the melt yielding hydrogen. This hydrogen is able to influence the partial pressure of carbon monoxide (derived by oxidation of the carbon) in the melt and so control the extent of oxidation of chromium and other readily oxidisable components in the melt during the decarburization. The oxygen fraction of the steam is consumed for the oxidation of carbon.

The basic decarburization process is described in detail in U.S. patent application Ser. No. 295,355 filed Oct. 10, 1972 by M. K. O. Johnsson and L. A. Eriksson, now U.S. Pat. No. 3,867,135 issued Feb. 18, 1975. Briefly, this decarburization process involves the use of a mixture of oxygen with a high percentage of steam and/or ammonia. During the main part of the decarburization period the volume ratio oxygen: steam + ammonia should preferably be less than 3:1 and a recommended value is between 1:1 and 1:10. It is also proposed that towards the end of the decarburization period pure steam should be injected into the molten alloy. It has been shown through experience that particularly the injection of pure steam has a great cooling effect on the steel in the region of the tuyere openings. As a result the tuyeres show a marked tendency to get blocked by solidification of the melt when pure steam is injected. The same result is achieved if the steam is admixed with any inert gas belonging to the group consisting of nitrogen, argon, helium, neon and xenon. The present invention provides a method of reducing the carbon content of an iron, cobalt or nickel based alloy containing carbon and at least 10% by weight chromium by introducing into the molten alloy, through at least one inner section of the tuyere which comprises at least two concentric tubes, essentially pure steam or steam and any inert gas belonging to the group consisting of nitrogen, argon, helium, neon and xenon, or steam and said inert gas or gases, bringing about an endothermal reaction when meeting the molten alloy but under conditions which reduce the tendency for the tuyeres to get blocked by frozen steel.

According to the invention the tendency of getting the tuyeres blocked by frozen steel is achieved by introducing through an outermost section of the tuyere a mixture of gaseous oxygen and any gas belonging to the group consisting of steam, nitrogen, argon, helium, neon and xenon, the gaseous oxygen content in said gas mixture being between 5 and 30% by volume, which gas mixture will undergo an exothermal reaction when it meets the molten alloy.

The invention will now be described more in detail, with reference to the accompanying drawing, which shows the principles for the design of a tuyere for use in the invention.

In the FIGURE, tuyere 1 consists of two concentric pipes, an inner pipe 2 and an outer pipe 3. The pipes can, for example, be made of copper, carbon steel or stainless steel. The opening between the pipes is indicated by 4. Speed, flow and number of tuyeres will determine the size of the tuyeres. A suitable diameter for the inner pipe is 5 to 15 mm and the width of opening 4 should be at least 0.5 mm but not more than 2 mm. Tuyere 1 extends through the bottom 6 (or the wall) of the converter or other process vessel, containing the melt 5 in process of decarburization. Tuyere 1 has a contraction 7, which divides the tuyere into two parts, namely a forward part 8 and a rear part 9. Forward part 8 has a narrower cross-section than rear part 9, but the ratio of the cross sectional areas of these two parts is equal. This arrangement brings about a pressure reduction in the delivery lines when the tuyere has undergone wear reaching the area of the contraction. This lowered pressure can be used as an indication that the tuyere or the bottom of the converter needs replacing. In an embodiment of the invention aiming at expliting this facility, the lines connected to the tuyere are therefore connected to suitable regulating members, which sense and register the pressure in the lines.

In order to ensure sufficient impulse when the gas mixture is injected into the melt, the injection speed should exceed the critical speed, i.e. that of sound. The total flow of gas through the tuyere or the tuyeres should be 0.5 to 5 standard cubic meters per metric ton of melt per minute (St.$m^3$/ton/min).

Towards the end of the decarburization period pure steam or a mixture of steam and any gas belonging to the group consisting of nitrogen, argon, helium, neon and xenon is injected through the inner pipe 2. According to a first preferred embodiment only pure steam is injected through the inner pipe 2. According to a second embodiment a mixture of steam and argon, the steam fraction corresponding to at least 50% by volume of the entire gas volume, is injected through the central pipe 2. According to a third embodiment steam and/or nitrogen is injected through the inner pipe 2, the steam fraction also in this case corresponding to at least 50% of the entire gas volume injected through the inner pipe 2. Under these circumstances, the gas injected through the inner pipe 2 has a very strong cooling effect because of the large amount of thermal energy required for the decomposition of the steam and for the heating of the gas volume to the temperature of the molten alloy. In order to reduce the tendency for the tuyere to become blocked by solidification of the melt in the region of the tuyere opening, a gas mixture having an exothermal reaction with the melt in the area of the the orifice of the tuyere is injected through opening 4 between inner pipe 2 and the outer pipe 3. Examples of suitable gas mixtures to be injected through opening 4 are:

1. A mixture of oxygen and steam
2. A mixture of oxygen and argon
3. A mixture of oxygen and nitrogen Also helium, neon and xenon can be considered wholly or partially to replace steam, argon and nitrogen. Combinations of the said gas mixtures are also conceivable. Independent on the choice of gas mixture the oxygen content in the mixture should be at least 5% by volume. However, the oxygen in the cooling mixture which is injected through the opening 4 is determined by the circumstances in each case. Factors which must be taken in consideration when choosing the content of gaseous oxygen in the cooling gas mixture injected through the opening 4 are:

a. The composition of the decarburization gas injected through the inner conduit 2. If the decarburization agent injected through the central conduit 2, or through the central pipe, consists of pure steam, the content of gaseous oxygen in the cooling gas mixture should be kept comparatively high and vice versa at high concentrations of other diluting gases then steam in the decarburization gas mixture.

b. The composition of the molten metal. If the molten metal contains or is supplied with high concentrations of silicon or other easily oxidized elements, large amounts of oxidation heat will be developed in the region of the mouth of the tuyere. The oxygen content in the cooling gas mixture in this case therefore can be reduced within the limits stipulated according to the invention.

c. The total flow through the tuyere and the ratio between the the flows in the central pipe 2 in the tuyere and in the outer opening 4 for the cooling gas mixture. The flow through the opening 4 should only represent a minor portion of the total flow, preferably less than 20% and suitably 10–15% by volume of the total flow. In order to ensure that the gas flow has a sufficient high impuls at the introduction in the molten metal, the speed should be supersonic. The speed and the flow thus are factors which influence the choice of oxygen content in the cooling gas mixture at the same time as they also determine the dimensions of the tuyeres. A suitable size of the diameter of the inner pipe is between 5 and 15 mm. The breadth of the opening 4 should be at least ½ mm and suitably not more than 2 mm.

Experiments have shown that a suitable oxygen content in the cooling gas mixture injected through the surrounding opening 4 in the case when pure steam is injected through the inner pipe 2, is 10–30%, preferably about 20%, by volume, at the same time as the flow through the outer opening 4 represents 10–15% of the total flow through the tuyere. Preferably the cooling gas mixture in this case is a mixture of steam and oxygen.

What we claim is:

1. A method of reducing the carbon content of an alloy based on a metal selected from the group consisting of iron, cobalt and nickel and also containing carbon and at least 10% by weight chromium by introducing into the molten alloy, through at least one inner section of a tuyere which comprises at least two concentric tubes, a first gas which is essentially pure steam or a mixture of steam and an inert gas selected from the group consisting of nitrogen, argon, helium, neon and xenon, said first gas bringing about an endothermic reaction when it meets the molten alloy, and introducing through an outermost section of the tuyere a second gas which is a mixture of gaseous oxygen and a gas selected from the group consisting of steam, nitrogen, argon, helium, neon and xenon, the gaseous oxygen content in said second gas being between 5 and 30% by volume, said second gas undergoing an exothermic reaction when it meets the molten alloy, said second gas being introduced into the molten alloy at the same time as said first gas is introduced to prevent blockage of the tuyere by frozen steel.

2. A method according to claim 1 wherein the flow of second gas through the outermost section of the tuyere represents 10 to 20% by volume of the total gas flow through the tuyere.

3. A method according to claim 1 wherein said second gas contains 10 to 30% by volume of oxygen.

* * * * *